US005850168A

United States Patent [19]

McVeety et al.

[11] Patent Number: 5,850,168

[45] Date of Patent: *Dec. 15, 1998

[54] CERAMIC TRANSVERSE-ELECTROMAGNETIC-MODE FILTER HAVING A WAVEGUIDE CAVITY MODE FREQUENCY SHIFTING VOID AND METHOD OF TUNING SAME

[75] Inventors: Thomas McVeety, Albuquerque; Truc Hoang, Rio Rancho, both of N. Mex.; Antonije Djordjevic, Belgrade, Yugoslavia

[73] Assignee: Motorola Inc., Schaumburg, Ill.

[ * ] Notice: The term of this patent shall not extend beyond the expiration date of Pat. No. 5,537,085.

[21] Appl. No.: 844,126

[22] Filed: Apr. 18, 1997

[51] Int. Cl.[6] ..... H01P 1/205; H01P 5/12

[52] U.S. Cl. ..... 333/207; 333/134

[58] Field of Search ..... 333/202, 206, 333/207, 222, 223, 235, 126, 129, 134

[56] References Cited

U.S. PATENT DOCUMENTS

| | | | |
|---|---|---|---|
| 4,431,977 | 2/1984 | Sokola et al. | 333/206 |
| 5,150,089 | 9/1992 | Komazaki et al. | 333/206 |
| 5,349,315 | 9/1994 | Ala-Kojola | 333/202 |
| 5,416,454 | 5/1995 | McVeety | 333/204 |
| 5,436,602 | 7/1995 | McVeety et al. | 333/206 |
| 5,537,085 | 7/1996 | McVeety | 333/206 |

FOREIGN PATENT DOCUMENTS

| | | | |
|---|---|---|---|
| 63-203002 | 8/1988 | Japan | 333/202 |

*Primary Examiner*—Seungsook Ham
*Attorney, Agent, or Firm*—Brian M. Mancini

[57] ABSTRACT

A ceramic transverse-electromagnetic-mode filter having a waveguide cavity mode frequency shifting void and method of tuning same is provided. The ceramic filter includes a filter body (200) comprising a block of dielectric material and having top (202), bottom (204) and four side surfaces (206, 208, 210, 212) including vertical edges (214). The filter also has metallized through-holes providing transverse-electromagnetic-mode resonators (216). At least one vertical portion in proximity to the vertical edges (214) of the block on at least one of the side surfaces is unmetallized providing a waveguide cavity mode frequency shifting void (218). The waveguide cavity mode frequency shifting void (218) shifts a set of parasitic spurious responses in the filter frequency response curve to a lower frequency while simultaneously maintaining a desired transverse-electromagnetic-mode passband.

7 Claims, 4 Drawing Sheets

CERAMIC TRANSVERSE-ELECTROMAGNETIC-MODE FILTER HAVING A WAVEGUIDE CAVITY MODE FREQUENCY SHIFTING VOID AND METHOD OF TUNING SAME

FIELD OF THE INVENTION

This invention relates generally to filters, and in particular to a ceramic transverse-electromagnetic-mode filter having a waveguide cavity mode frequency shifting void and method of tuning same.

BACKGROUND OF THE INVENTION

Filters are known to provide attenuation of signals having frequencies outside of a particular frequency range and little attenuation to signals having frequencies within the particular frequency range of interest. As is also known, these filters may be fabricated from ceramic materials having one or more transverse-electromagnetic-mode (hereafter "TEM-mode") resonators coupled together and formed therein. TEM-mode means that the electric and magnetic fields are in a direction that is perpendicular to the direction of wave propagation in a filter block. A ceramic filter may be constructed to provide a lowpass filter, a bandpass filter, a bandstop filter, or a highpass filter.

FIG. 1 shows a representative prior art ceramic monolithic block filter 100. This filter contains a series of resonators 102 which extend from a top surface 104 to a bottom surface 106 of the block. The resonators 102 are capacitively coupled to an input pad 108 and an output pad 110. All external surfaces of the filter 100 are substantially covered with a conductive metallization coating with an exception of an area 112 surrounding the input pad 108 and the output pad 110 as well as an area 114 surrounding the resonators 102 on the top surface 104 of the filter block 100. It is notable that the metallization layer provides a substantially encapsulated casing for the energy which flows through the filter block 100.

At the design passband, the filter structure dominantly supports TEM-mode waves. Hence, the filter properties can be well predicted using the theory of TEM guided waves and telegrapher's equations relating to transmission line theory during modeling operations. However, away from the design passband, all filters have more or less pronounced parasitic passbands and other regions of poor attenuation. These problematic parasitic passbands are usually more obvious above the design passband, but they may also be present below the design passband. From a practical standpoint, these parasitic passbands may cause particular problems if they coincide with the 2nd and 3rd harmonics of the fundamental transmitter frequency, as strong harmonics of the transmitter frequency may be fed into the antenna.

The potential problems presented by these unwanted parasitic passbands cannot be understated. Oftentimes, these passbands will result in interference or unwanted noise in the signal. If the interference is sufficiently strong, it may result in the telephone call in the cellular system being dropped. Additionally, the transmission of harmonics at higher frequencies may create issues for a telecommunications provider which may have to be dealt with by the Federal Communication Commission (FCC).

Consequently, many designers of systems such as cellular telephones need additional attenuation over that provided by traditional ceramic monolithic block filters. To address this problem, designers oftentimes place a second lowpass filter in-line to suppress unwanted harmonic responses. This solution, unfortunately, is both expensive and time consuming, and may significantly add to the cost weight, and part-count of a completed product such as a cellular telephone, pager, or other electronic signal processing apparatus.

Another solution to the problem of unwanted parasitic passbands is to add lumped components to the printed circuit board, thereby creating an additional filter assembly which properly couples to the original filter and eliminates the unwanted higher frequencies. This solution is also expensive, labor intensive, and time consuming.

A ceramic filter design which addresses the problem of harmonic response suppression by shifting the position of unwanted parasitic passbands relative to the design passband without the addition of a second filter or lumped elements may result in a substantial savings in both space and cost. A ceramic filter having a waveguide cavity mode frequency shifting void feature, which moves unwanted parasitic passbands away from the design passband harmonics would be considered an improvement in the art.

DETAILED DESCRIPTION OF THE PREFERRED EMBODIMENT

Figure 2A:
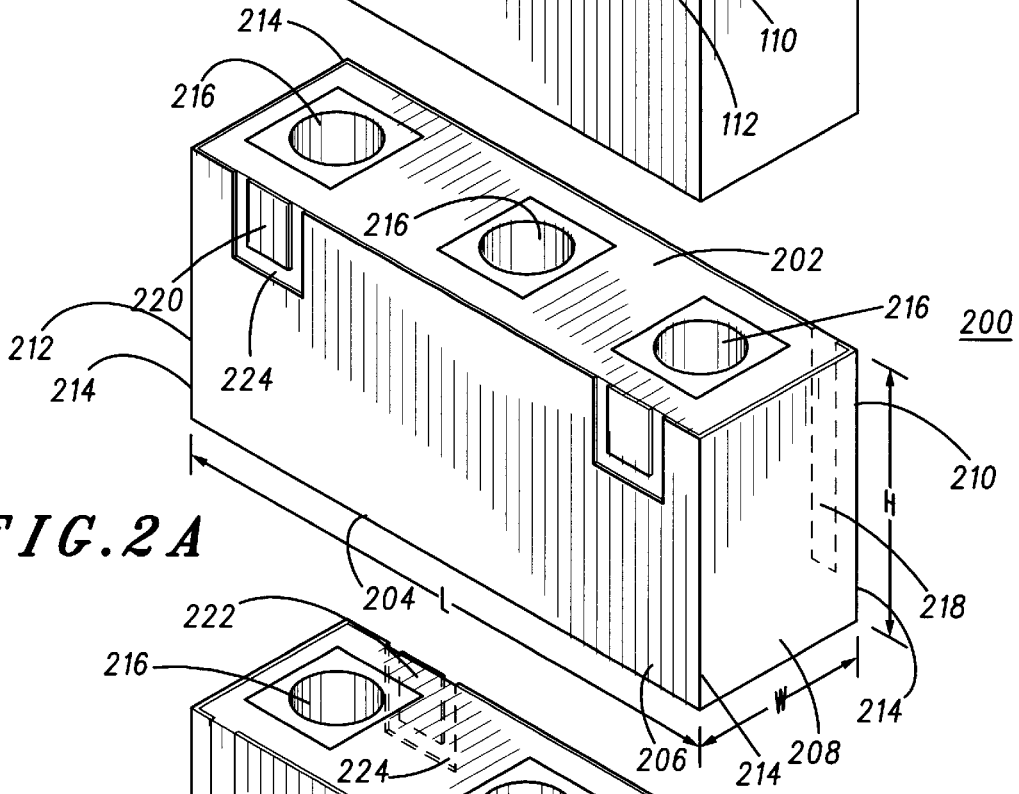
FIG. 2A shows a rear view of a ceramic filter having a waveguide cavity mode frequency shifting void, in accordance with the present invention.

FIG. 2A shows a rear view of a ceramic filter having a waveguide cavity mode frequency shifting void. Referring to FIG. 2A, a ceramic filter 200 is provided. Filter 200 includes a filter body made from a block of dielectric material and having a top surface 202, a bottom surface 204, and four side surfaces 206, 208, 210 and 212 respectively. Filter 200 also includes four vertical edges 214. A plurality of metallized through-holes extending from the top surface 202 to the bottom surfaces 204 define transverse-electromagnetic-mode resonators 216.

The external surfaces 204, 206, 208, 210 and 212 are substantially covered with a conductive material defining a metallized layer, with the exception that the top surface 202 is substantially uncoated. Additionally, at least one vertical portion in proximity to the vertical edges 214 of the block 200 on at least one of the side surfaces is unmetallized defining a waveguide cavity mode frequency shifting void 218. The waveguide cavity mode frequency shifting void (also referred to as "the void") is represented with dashed lines in FIG. 2A.

The waveguide cavity mode frequency shifting void 218 extends substantially vertically in proximity to a vertical edge 214 of the block 200 and with a substantially uniform width. Void 218 extends parallel to the resonators 216 a distance to shift a set of parasitic spurious responses (unwanted parasitic passbands) in the filter frequency response curve to a lower frequency while simultaneously maintaining a desired transverse-electromagnetic-mode (TEM-mode) passband (see FIG. 6 discussed below).

First and second input-output pads (220, 222 respectively) comprising an area of conductive material on at least one of the side surfaces and substantially surrounded by an uncoated area of the dielectric material 224 are also shown in FIG. 2A. Finally, FIG. 2A shows the height (h), width (w), and length (L) dimensions of the dielectric block of ceramic.

Figure 2B:
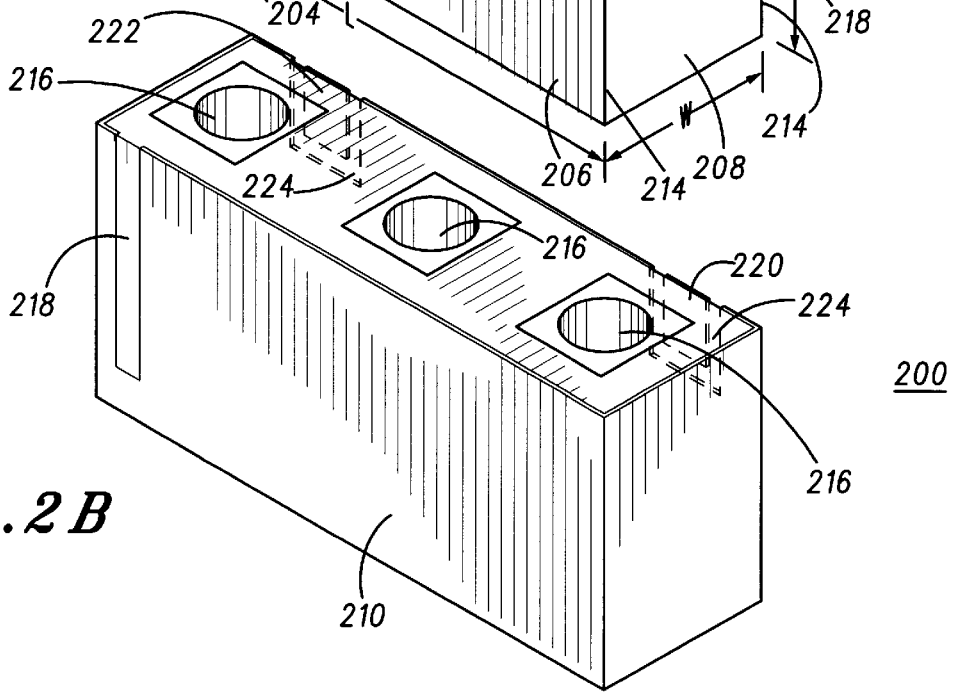
FIG. 2B shows a front view of the ceramic filter having a waveguide cavity mode frequency shifting void of FIG. 2A, in accordance with the present invention.

FIG. 2B shows a front view of the ceramic filter having a waveguide cavity mode frequency shifting void of FIG. 2A. Similar to FIG. 2A, this view shows filter 200 having TEM-mode resonators 216, as well an electrical input pad 220 and an electrical output pad 222, both surrounded by an unmetallized area of dielectric material 224. This view also clearly shows the waveguide cavity mode frequency shifting void 218, which is an important part of the present invention and is represented with a solid line on the front surface 210 of the filter block 200.

Figure 3:
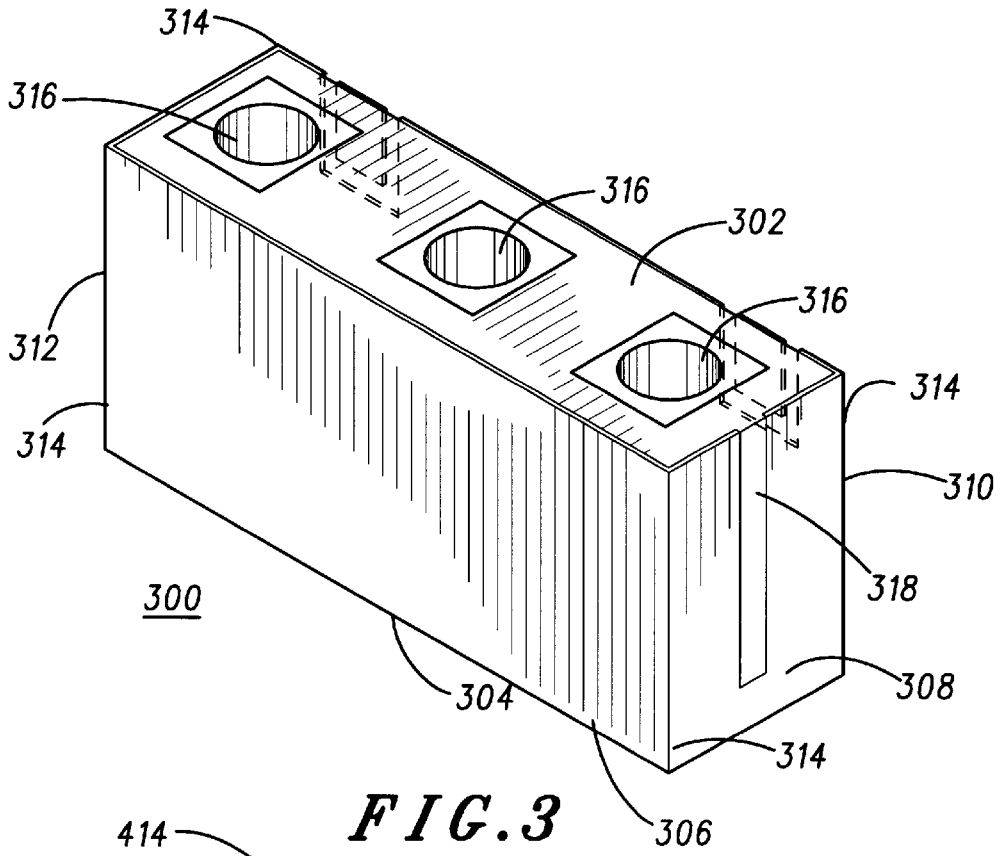
FIG. 3 shows an embodiment in which the waveguide cavity mode frequency shifting void is on another one of the side surfaces, in accordance with the present invention.

FIG. 3 shows another embodiment of the present invention in which a waveguide cavity mode frequency shifting void 318 is on another side surface 308 of filter 300. Referring to FIG. 3, a ceramic filter 300 is provided. Filter 300 includes a filter body made from a block of dielectric material and having a top surface 302, a bottom surface 304, and four side surfaces 306, 308, 310 and 312 respectively. Filter 300 also includes four vertical edges 314. A plurality of metallized through-holes extending from the top 302 to the bottom surfaces 304 define TEM-mode resonators 316.

The external surfaces 304, 306, 308, 310 and 312 are substantially covered with a conductive material defining a metallized layer, with the exception that the top surface 302 is substantially uncoated. Additionally, at least one vertical portion in proximity to the vertical edges 314 of the block 300 on at least one of the side surfaces is unmetallized defining a waveguide cavity mode frequency shifting void 318.

The waveguide cavity mode frequency shifting void 318 extends substantially vertically in proximity to the vertical edges 314 of the block 300 and with a substantially uniform width. Void 318 extends parallel to the resonators 316 a distance to shift a set of parasitic spurious responses in the filter frequency response curve to a lower frequency while simultaneously maintaining a desired TEM-mode passband (see FIG. 6 discussed below).

It should be noted that in FIG. 3, void 318 is located on side surface 308 of the filter block 300. Void 318 may be located on any of the four side surface 306, 308, 310, or 312. In a preferred embodiment, void 318 will be located in proximity to one of the vertical edges 314 and extend substantially parallel to resonators 316.

Figure 4:
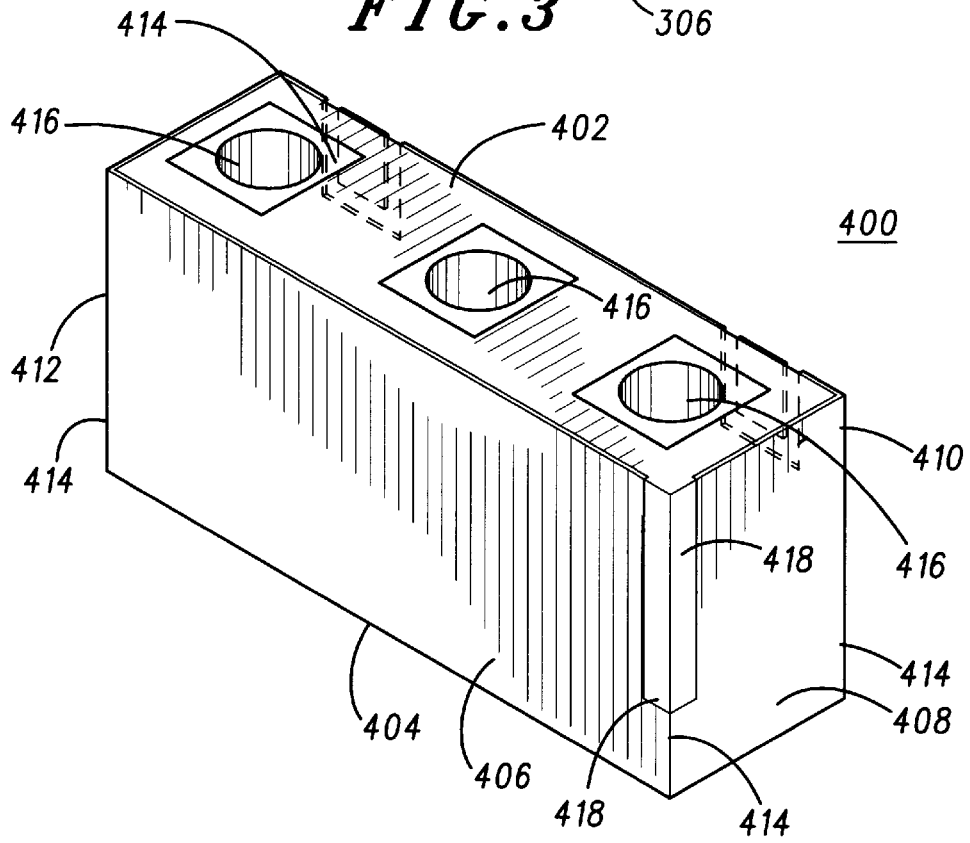
FIG. 4 shows an embodiment in which the waveguide cavity mode frequency shifting void is wrapped around two side surfaces, in accordance with the present invention.

FIG. 4 shows an embodiment of the present invention in which a waveguide cavity mode frequency shifting void 418 is wrapped around two side surfaces of the filter block 400. Referring to FIG. 4, a ceramic filter 400 is provided. Filter 400 includes a filter body made from a block of dielectric material and having a top surface 402, a bottom surface 404, and four side surfaces 406, 408, 410 and 412 respectively. Filter 400 also includes four vertical edges 414. A plurality of metallized through-holes extending from the top surface 402 to the bottom surfaces 404 define TEM-mode resonators 416.

The external surfaces 404, 406, 408, 410 and 412 are substantially covered with a conductive material defining a metallized layer, with the exception that the top surface 402 is substantially uncoated. Additionally, at least one vertical portion in proximity to the vertical edges 414 of the block 400 on at least one of the side surfaces is unmetallized defining a waveguide cavity mode frequency shifting void 418. On filter 400, void 418 wraps around two side surfaces, namely surfaces 406 and 408.

The waveguide cavity mode frequency shifting void 418 extends substantially vertically in proximity to the vertical edges 414 of the block 400 and with a substantially uniform width. Void 418 extends substantially parallel to the resonators 416 a distance to shift a set of parasitic spurious responses in the filter frequency response curve to a lower frequency while simultaneously maintaining a desired TEM-mode passband (see FIG. 6 discussed below).

Figure 5:
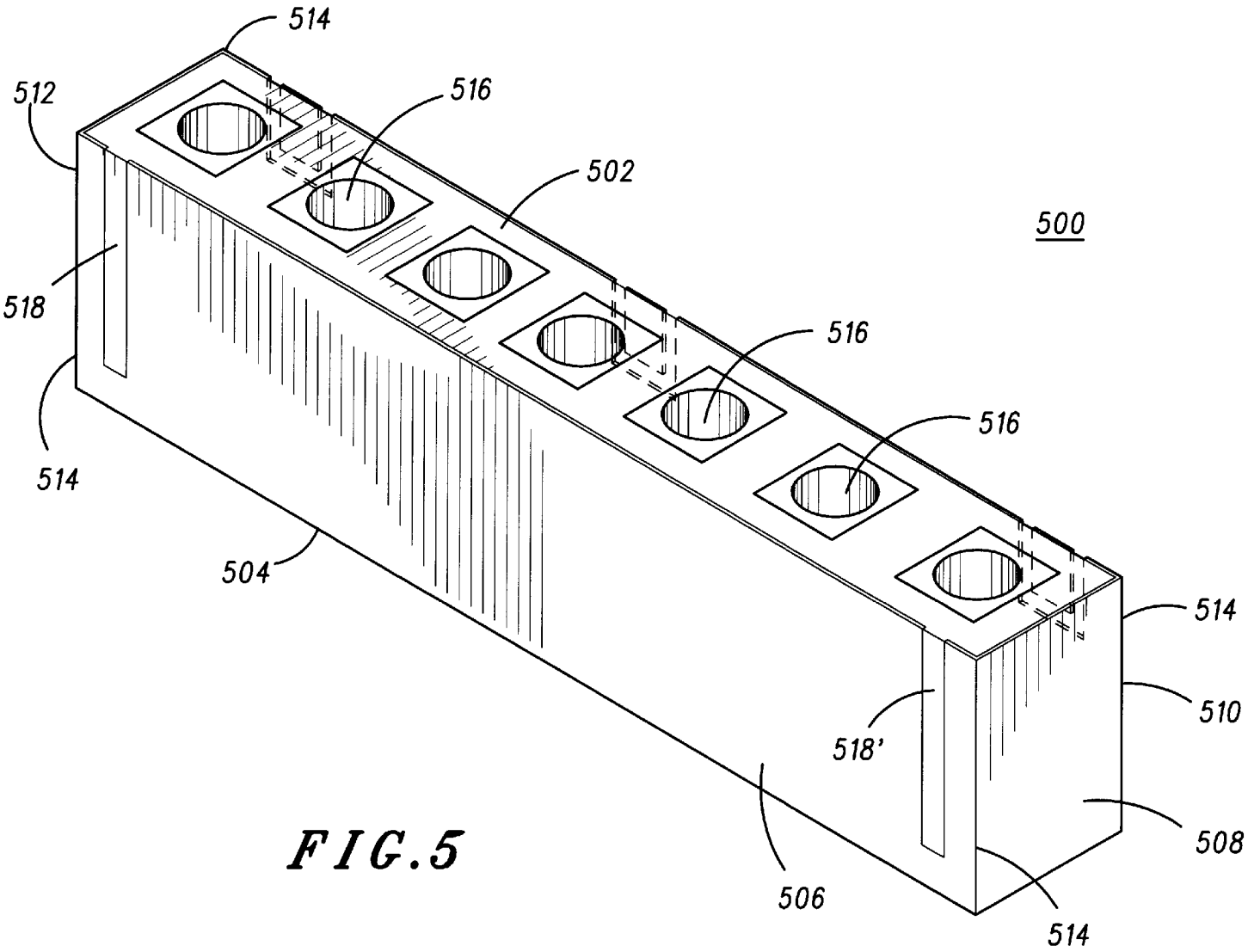
FIG. 5 shows an embodiment in which two waveguide cavity mode frequency shifting voids are placed on a single side surface of a duplex filter, in accordance with the present invention.

FIG. 5 shows an embodiment in which two waveguide cavity mode frequency shifting voids, 518 and 518', are placed on a single side surface 506 of a duplex filter. Referring to FIG. 5, a ceramic filter 500 is provided. Filter 500 includes a filter body made from a block of dielectric material and having a top surface 502, a bottom surface 504, and four side surfaces 506, 508, 510 and 512 respectively. Filter 500 also includes four vertical edges 514. A plurality of metallized through-holes extending from the top 502 to the bottom surfaces 504 define TEM-mode resonators 516.

The external surfaces 504, 506, 508, 510 and 512 are substantially covered with a conductive material defining a metallized layer, with the exception that the top surface 502 is substantially uncoated. Additionally, at least one vertical portion in proximity to the vertical edges 514 of the block 500 on at least one of the side surfaces is unmetallized defining a pair of waveguide cavity mode frequency shifting voids 518, 518'. On filter 500, voids 518 and 518' are both located on the same side surface 506 of filter block 500.

The waveguide cavity mode frequency shifting voids 518, 518' extend substantially vertically in proximity to the vertical edges 514 of the block 500 and with a substantially uniform width. Voids 518, 518' extend substantially parallel to the resonators 516.

Figure 1:
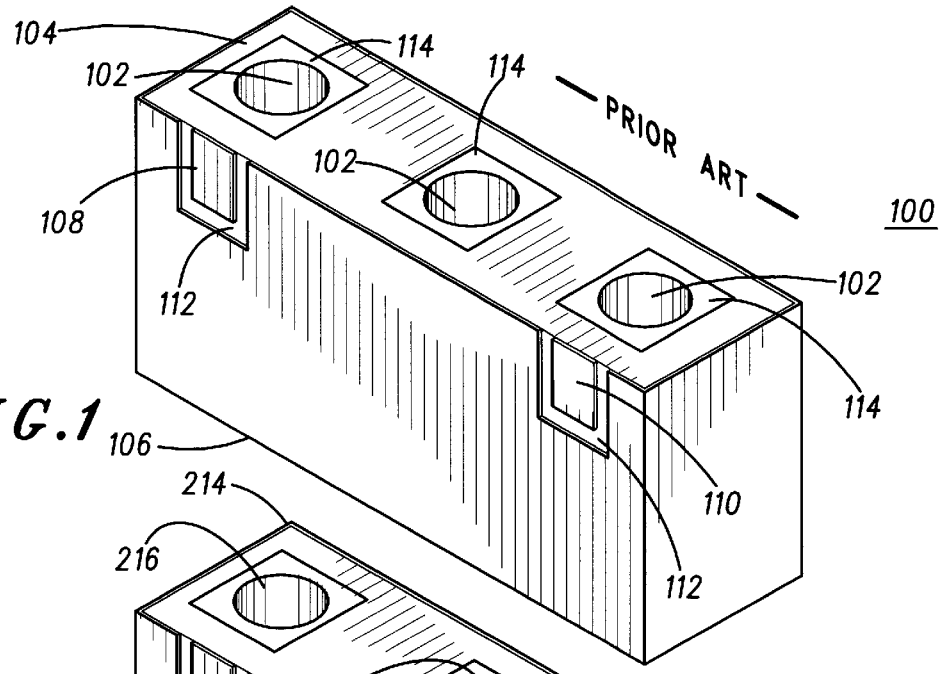
FIG. 1 shows a prior art dielectric ceramic monolithic block filter.
Figure 6:
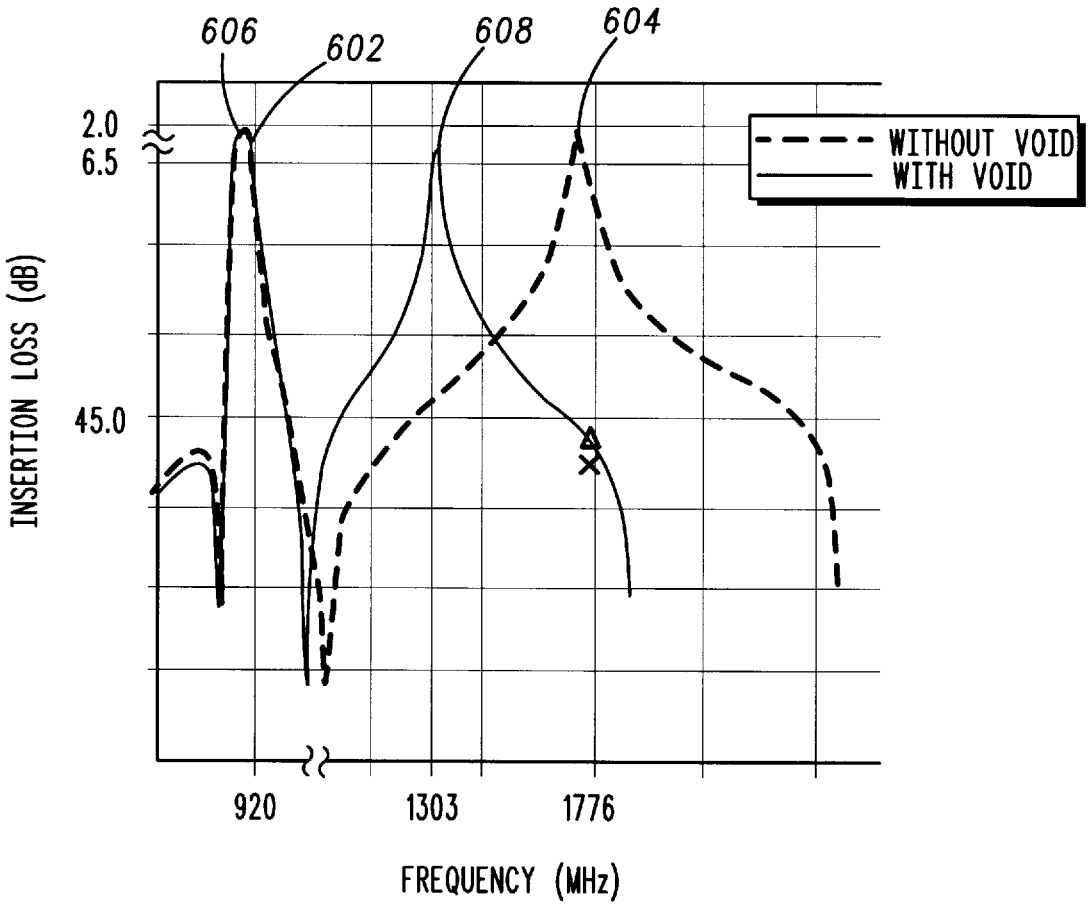
FIG. 6 shows a graph of the insertion loss versus frequency for a prior art filter and a filter in accordance with the present invention.

FIG. 6 shows a graph of the insertion loss versus frequency for a prior art filter and a filter of the present invention. In FIG. 6, a prior art filter, such as the one shown in FIG. 1, may have a frequency response as shown by the dashed line. Without the void (218 in FIG. 2, 318 in FIG. 3, 418 in FIG. 4, and 518, 518' in FIG. 5), the filter will have a design passband 602 as well as an unwanted parasitic passband 604. If a certain insertion loss specification (shown as "x" in FIG. 6) is required, a filter without a void could not easily meet this specification.

Now referring to the frequency response curve for a filter having the void, shown as a solid line in FIG. 6, the result is changed significantly with the addition of the void feature. A frequency response curve for a filter having a void, as shown in FIG. 2 for example, will have a design passband 606 as well as an unwanted parasitic passband 608. It is important to note that the addition of the void feature changes or shifts the frequency of the unwanted parasitic passband 608 significantly, while leaving the design passband 606 virtually unchanged. As a result, if a certain insertion loss specification (shown as "x" in FIG. 6) were required for the filter with the void, that specification could be met as a direct result of the void on a side surface of a filter block. The ability to shift the position of an unwanted parasitic passband is a valuable design tool for radio frequency design engineers.

Referring to FIG. 6, the height of the parasitic passbands 604, 608 will depend on many design factors. However, in general, the peak height will be related to the spacing between the input pad (220 in FIG. 2A) and the output pad (222 in FIG. 2A). Typically, the further apart the input pad 220 is from the output pad 222 on the side surface 206 of the filter block 200, the lower will be the peaks of the unwanted parasitic passbands. Nevertheless, depending upon design specifications, the peaks may require shifting regardless of their relative heights.

In FIG. 6, both passbands 602 and 606 are at about 920 MHz and at about 2.0 dB insertion loss. The prior art unwanted passband which did not contain a void was at about 1776 MHz at about 6.5 dB insertion loss. After the void was added to a side surface of the filter block, the unwanted passband (formerly 604) is shifted down in frequency to about 1303 MHz at about 6.5 dB insertion loss (see 608 in FIG. 6). This enabled the filter block of the present invention having a void to have approximately 45.0 dB insertion loss at 1776 MHz, thereby meeting the "x" specification in FIG. 6. FIG. 6 shows graphically how the addition of the waveguide cavity mode frequency shifting void repositions the unwanted passbands from 604 to 608 while leaving the design passband (602, 606) virtually unchanged.

Applicants postulate that the presence of stray spurious signals in the form of unwanted passbands in the filter frequency response curve in the region of the second and third harmonics is due to the existence of waveguide resonant modes in addition to the TEM-mode which defines the passband of interest (also called the design passband). These unwanted passbands are in addition to a natural TEM second passband which is at about the third harmonic or higher.

The insertion of a waveguide cavity mode frequency shifting void, in the form of a small vertical slot on a side surface of the block is believed, by the applicants, to stretch the waveguide cavity mode current path and consequently cause a shift, to a lower frequency, of these unwanted passbands (spurious signals). Stated another way, the purposefully inserted void creates an obstruction to the path of the waveguide resonant mode currents which propagate on the metallized surfaces of the filter blocks.

One important aspect of the present invention is that by strategically placing the waveguide cavity mode frequency shifting void on a side surface of the filter block, away from the resonators, the TEM-mode currents are virtually unaffected. Thus, the passband of interest remains virtually unchanged, while the unwanted passbands can be moved substantially down to a lower frequency.

This feature of the present invention gives a designer more options in the design of filters and also gives the designer another method to meet difficult specifications. Moreover, since waveguide modes have a maximum current flow at the edges, the strategic placement of the void near the vertical edges of the block effectively diverts this flow and creates a shift down in frequency of the spurious parasitic responses.

It is significant to note that when the waveguide cavity mode frequency shifting void is properly placed on a side surface of the filter block, the void will effect all waveguide cavity modes. By creating a void, the resonant frequencies of all cavity modes whose current distribution is disturbed by the void are shifted. This does not mean, however, that all modes are shifted the exact same frequency distance down in frequency. The extent to which each mode will shift will depend on numerous other design variables.

The application of waveguide cavity mode theory to a monolithic block filter having resonators which are known to operate in TEM-mode is a new and unusual approach to a known problem. This becomes more apparent as attempts are made to model the behavior of electromagnetic fields in the filter block itself. These inventors have found that while the TEM-mode characteristics are strongly dependent upon design parameters such as size, location, and spacing of the resonator through-holes, the waveguide cavity mode characteristics are relatively standard and somewhat independent of these variables. As such, a relatively simple design feature such as the waveguide cavity mode frequency shifting void may cause an enormous interruption in the waveguide characteristics of the TEM-mode filter.

The waveguide resonance modes are excited and coupled into the final filter response through the filter input and output pads as well as by the metallized top-print patterns near the open end of the TEM-mode resonators. As such, at the input and output ports, modeled simulations show both TEM-mode and waveguide resonance mode characteristics.

The use of a waveguide cavity mode frequency shifting void on a side surface of a monolithic block of ceramic is an entirely new method of addressing the problem of unwanted passbands. Formerly, methods of removing unwanted passbands oftentimes resulted in additional components and complexity and invariably changed the design passband as well. The use of a waveguide cavity mode frequency shifting void to shift unwanted passbands has the advantage of leaving the design passband unchanged. This allows a designer to meet specifications in a two step process. First, the design passband is achieved, then the unwanted passbands are shifted down in frequency to a region where they are non-obstructive.

Significantly, the physical size of the waveguide cavity mode frequency shifting void effects the extent to which the frequency will shift in the unwanted passbands. Generally, the larger the void the greater the downward shift in frequency. With certain designs, it may even be possible to shift the frequency a few hundred megahertz or more. This is significant because certain specifications call for attenuation of an undesired passband which is merely about fifty megahertz wide. The ability to shift a response by a few hundred megahertz in such an environment is a most valuable capability and feature with the present invention. The physical size of the void is usually increased by extending its length down the side surface of the filter block while maintaining a constant width in the void.

The waveguide cavity mode frequency shifting void may also be used to perform other functions. For example, the waveguide cavity mode frequency shifting void may be used to adjust a second natural TEM passband which is related necessarily to the design TEM passband. This is accomplished by a technique which loads the second natural TEM passband. Again, this offers a designer another variable with which to employ in complex filter designs.

Still another technique used to cause a greater shift in frequency downward in the unwanted passbands is to introduce additional waveguide cavity mode frequency shifting voids on the same or other side surfaces of the filter block. In a preferred embodiment, a single void will provide all the desired movement (shift down in frequency) of the unwanted passbands.

However, in other embodiments, two or more voids may be introduced, on various side surfaces, to further increase the length of or stretch the waveguide cavity mode currents and consequently cause an even greater shift, to a lower frequency, of these unwanted passbands (spurious signals). In fact, for larger filter blocks, it may be necessary to place additional voids on the surface of the filter block to effectively shift all the unwanted passbands.

The existence of spurious parasitic responses has been a challenge to filter designers for some time. Traditionally, they have been analyzed using conventional TEM-mode modeling and analysis. Whereas conventional transmission line filters repeat themselves at periodic controllable intervals from a fundamental frequency, this does not explain the presence of spurious parasitic responses in the filter response. The present invention suggests dual TEM-mode and waveguide mode phenomena occurring inside the filter block to explain the presence of unwanted passbands.

By recognizing that the introduction of a waveguide cavity mode frequency shifting void, or more specifically, the removal of a pre-existing layer of metallization in a specific region of the block, affects the frequency of unwanted passbands, this phenomenon may be utilized to accurately tune the filter itself. A method of tuning a dielectric block filter which comprises multiple steps may be established. First, the desired design passband is established. This may be accomplished using conventionally known and established tuning techniques such as removing electrode material from an edge defined by the top surface of the filter block and a resonator through-hole. This affects the loading of the filter and, under traditional transmission line theory, provides a passband.

Next, the passband must be manipulated to meet the desired specifications and achieve a desired profile. This is accomplished by repeating for each resonator the step described above until a desired TEM-mode passband is achieved.

Once the desired passband is obtained, the issue of parasitic passbands (undesired spurious responses) can then be addressed. It is at this point that the waveguide cavity mode frequency shifting void may be placed on a side surface of the filter block by removing the metallization material from a side surface substantially vertically in proximity to the vertical edges of the block to provide a waveguide cavity mode frequency shifting void.

Next, the effect of the waveguide cavity mode frequency shifting void can be measured by checking a frequency response curve of the filter to confirm that the introduction of the waveguide cavity mode frequency shifting void actually lowers the frequency of a set of parasitic passbands by a predetermined frequency while simultaneously maintaining a desired TEM-mode passband.

The tuning process continues when the size of the waveguide cavity mode frequency shifting void is enlarged, typically by lengthening the void, until all unwanted parasitic passbands are shifted to meet a predetermined filter specification. Of course, once an optimal design has been achieved for a given set of specifications, the void dimensions may be measured and a similarly sized void may be applied to subsequent blocks via other methods such as screen-printing, patterning, or other deposition techniques. Thus, the present invention provides a method of tuning TEM-mode filters to shift unwanted parasitic passbands.

The present invention postulates that waveguide mode paths, inside the filter block itself, may be the cause of these parasitic spurious responses. The open top surface of a conventional prior art high dielectric ceramic filter acts as a magnetic wall and, from a modeling perspective, provides a surface for the total reflection of waveguide modes, which can also be regarded as a mirror-imaging surface. As such, the computer models used to simulate the flow of current through the block, in the waveguide mode, contemplate a block of twice the volume of the actual monolithic ceramic filter. Additionally, the waveguide mode shifting void originates in proximity to the top surface of the physical filter block.

This concept may be more easily understood with reference to a set of formulas and equations which may better explain the postulated electromagnetic field modes in the filter block.

The formula for the cavity resonant frequency is a modified version of the classical formula for a rectangular box and is shown as:

$$f_{res} = \frac{c}{2}\sqrt{\left(\frac{m}{L}\right)^2 + \left(\frac{n}{2h}\right)^2 + \left(\frac{p}{w}\right)^2} \tag{1.1}$$

where $$c = 3.0 \times 10^8/\sqrt{\epsilon_r}\ \text{meters/second} \tag{1.2}$$

and where:

$f_{res}$=the resonant frequency;

c=the TEM wave velocity in the ceramic material;

w=the block width (see FIG. 2A);

L=the length of the filter block (see FIG. 2A);

h=the height of the block (see FIG. 2A);

m,n,p=non-negative integers of which at least two must be positive and where n must be an odd number;

$\epsilon_r$=the relative permittivity of the ceramic material.

Referring to equation (1.1) above, as the width (w) dimension becomes substantially less than the height (h) and length (L) dimensions in a filter block, the "p" value is set at zero and the "n, m" values become positive integers for the lowest resonant frequencies.

Although various embodiments of this invention have been shown and described, it should be understood that various modifications and substitutions, as well as rearrangements and combinations of the preceding embodiments, can be made by those skilled in the art, without departing from the novel spirit and scope of this invention.

What is claimed is:

1. A ceramic filter, comprising:

a filter body comprising a block of dielectric material and having top, bottom and four side surfaces including vertical edges, and having a plurality of metallized through-holes extending from the top to the bottom surfaces defining transverse-electromagnetic-mode resonators, the surfaces being substantially covered with a conductive material defining a metallized layer, with the exception that the top surface is substantially uncoated, and with an additional exception that at least one vertical portion in proximity to the vertical edges of the block on at least one of the side surfaces is unmetallized defining a waveguide cavity mode frequency shifting void;

the waveguide cavity mode frequency shifting void extending substantially vertically in proximity to the vertical edges of the block and with a substantially uniform width and extending a distance to shift a set of parasitic spurious responses in the filter frequency response curve to a lower frequency while simultaneously maintaining a desired transverse-electromagnetic-mode passband; and first and second input-output pads comprising an area of conductive material on at least one of the side surfaces and substantially surrounded by an uncoated area of the dielectric material.

2. The filter of claim 1, wherein the waveguide cavity mode frequency shifting void extends from the top surface of the block to about one-half way down one of the side surfaces of the block.

3. The filter of claim 1, wherein the waveguide cavity mode frequency shifting void is on one side surface the filter block and a second waveguide cavity mode frequency shifting void is on an opposite side surface of the filter block.

4. The filter of claim 1, wherein the waveguide cavity mode frequency shifting void is on one side surface the filter block and a second waveguide cavity mode frequency shifting void is on the same side surface of the filter block.

5. The filter of claim 1, wherein the waveguide cavity mode frequency shifting void adjusts a second natural passband.

6. A method of tuning a dielectric ceramic block filter having four vertical edges comprising the steps of:

removing metallization material from an edge defined by a top surface of the filter block and a resonator through-hole;

repeating for each resonator until a desired transverse-electromagnetic-mode passband is achieved;

removing metallization material from a side surface substantially in proximity to at least one of the four vertical edges of the block to provide a waveguide cavity mode frequency shifting void;

checking a frequency response curve of the filter to confirm that the introduction of the waveguide cavity mode frequency shifting lowers the frequency of a set of parasitic passbands by a predetermined frequency while simultaneously maintaining a desired transverse-electromagnetic-mode passband; and enlarging the size of the waveguide cavity mode frequency shifting void until all unwanted parasitic passbands are shifted to meet a predetermined filter specification.

7. A ceramic duplex filter, comprising:

a filter body comprising a block of dielectric material and having top, bottom and four side surfaces including vertical edges, and having a plurality of metallized through-holes extending from the top to the bottom surfaces defining transverse-electromagnetic-mode resonators, the surfaces being substantially covered with a conductive material defining a metallized layer, with the exception that the top surface is substantially uncoated, and with an additional exception that at least one vertical portion in proximity to the vertical edges of the block on at least one of the side surfaces is unmetallized defining a waveguide cavity mode frequency shifting void;

the waveguide cavity mode frequency shifting void extending substantially vertically in proximity to the vertical edges of the block and with a substantially uniform width and extending a distance to shift a set of parasitic spurious responses in the filter frequency response curve to a lower frequency while simultaneously maintaining a desired transverse-electromagnetic-mode passband; and first and second and third input-output pads comprising an area of conductive material on at least one of the side surfaces and substantially surrounded by an uncoated area of the dielectric material.

* * * * *